US009180941B1

(12) United States Patent
Vandenworm

(10) Patent No.: US 9,180,941 B1
(45) Date of Patent: Nov. 10, 2015

(54) METHOD USING A FLOATABLE OFFSHORE DEPOT

(71) Applicant: JURONG SHIPYARD PTE LTD., Singapore (SG)

(72) Inventor: Nicolaas Johannes Vandenworm, Houston, TX (US)

(73) Assignee: JURONG SHIPYARD PTE LTD., Singapore (SG)

( * ) Notice: Subject to any disclaimer, the term of this patent is extended or adjusted under 35 U.S.C. 154(b) by 0 days.

(21) Appl. No.: 14/630,576

(22) Filed: Feb. 24, 2015

Related U.S. Application Data

(63) Continuation-in-part of application No. 14/524,992, filed on Oct. 27, 2014, which is a continuation-in-part of application No. 14/105,321, filed on Dec. 13, 2013, now Pat. No. 8,869,727, which is a continuation-in-part of application No. 13/369,600, filed on Feb. 9, 2012, now Pat. No. 8,662,000, which is a continuation-in-part of application No. 12/914,709, filed on Oct. 28, 2010, now Pat. No. 8,251,003.

(60) Provisional application No. 61/521,701, filed on Aug. 9, 2011, provisional application No. 61/259,201, filed on Nov. 8, 2009, provisional application No. 61/262,533, filed on Nov. 18, 2009.

(51) Int. Cl.

| | |
|---|---|
| ***B63B 35/40*** | (2006.01) |
| ***B63B 35/50*** | (2006.01) |
| ***B63B 21/50*** | (2006.01) |
| ***B63H 25/42*** | (2006.01) |

(52) U.S. Cl.
CPC ..... *B63B 35/40* (2013.01); *B63B 21/50* (2013.01); *B63B 35/50* (2013.01); *B63H 25/42* (2013.01)

(58) Field of Classification Search
USPC ..... 114/259, 264, 263, 248
IPC ..... B63B 35/40,27/36
See application file for complete search history.

(56) References Cited

U.S. PATENT DOCUMENTS

| | | | | |
|---|---|---|---|---|
| 2,156,635 | A | 5/1939 | Mascuch et al. | |
| 3,041,639 | A | 7/1962 | Atlas | |
| 4,282,822 | A | 8/1981 | Jackson | |
| 4,446,808 | A | 5/1984 | Colin | |
| 4,549,835 | A | 10/1985 | Ando et al. | |
| 4,640,214 | A * | 2/1987 | Bruns | 114/263 |
| 4,679,517 | A | 7/1987 | Kramer | |

(Continued)

FOREIGN PATENT DOCUMENTS

WO 2009136799 A1 11/2009

*Primary Examiner* — Stephen Avila
(74) *Attorney, Agent, or Firm* — Buskop Law Group, PC; Wendy Buskop

(57) ABSTRACT

A method using a floatable offshore depot to provide sheltered area using a tunnel for safe and easy launching or docking of watercraft and embarkation or debarkation of personnel. The method can be used to transfer equipment between the watercraft and the floatable offshore depot using an internal dock side of the tunnel. The floatable offshore depot can have a buoyant hull, a keel, a main deck, and at least two connected sections between the keel and the main deck. The connected sections can extend downwardly from the main deck toward the keel and can have an upper cylindrical side section, a transition section, and a lower cylindrical section. The method uses the tunnel at an operational depth, with a tunnel opening to an exterior of the buoyant hull to receive the watercraft.

20 Claims, 12 Drawing Sheets

(56) References Cited

U.S. PATENT DOCUMENTS

| | | | | |
|---|---|---|---|---|
| 4,984,935 | A | 1/1991 | de Oliveira Filho et al. | |
| 5,573,353 | A | 11/1996 | Recalde | |
| 6,347,424 | B1 * | 2/2002 | Vatne | 14/69.5 |
| 6,431,107 | B1 | 8/2002 | Byle | |
| 6,761,508 | B1 * | 7/2004 | Haun | 405/224 |
| 6,945,736 | B2 | 9/2005 | Smedal et al. | |
| 7,958,835 | B2 | 6/2011 | Srinivasan | |
| 8,251,003 | B2 | 8/2012 | Vandenworm | |
| 8,662,000 | B2 | 3/2014 | Vandenworm | |
| 2009/0126616 | A1 | 5/2009 | Srinivasan | |
| 2013/0133563 | A1 | 5/2013 | Kroecker | |
| 2014/0290553 | A1 | 10/2014 | Syvertsen et al. | |

* cited by examiner

METHOD USING A FLOATABLE OFFSHORE DEPOT

CROSS REFERENCE TO RELATED APPLICATIONS

The present application is a Continuation in Part of co-pending U.S. patent application Ser. No. 14/524,992 filed on Oct. 27, 2014, entitled "BUOYANT STRUCTURE," which is a Continuation in Part of U.S. patent application Ser. No. 14/105,321 filed on Dec. 13, 2013, entitled "FLOATING VESSEL," now issued as U.S. Pat. No. 8,869,727 on Oct. 28, 2014, which is a Continuation in Part of U.S. patent application Ser. No. 13/369,600 filed on Feb. 9, 2012, entitled "STABLE OFFSHORE FLOATING DEPOT," now issued as U.S. Pat. No. 8,662,000 on Mar. 4, 2014, which is a Continuation in Part of U.S. patent application Ser. No. 12/914,709 filed on Oct. 28, 2010, now issued as U.S. Pat. No. 8,251,003 on Aug. 28, 2012, which claims the benefit of U.S. Provisional Patent Application Ser. No. 61/521,701 filed on Aug. 9, 2011, U.S. Provisional Patent Application Ser. No. 61/259,201 filed on Nov. 8, 2009 and U.S. Provisional Patent Application Ser. No. 61/262,533 filed on Nov. 18, 2009. These references are hereby incorporated in their entirety.

FIELD

The present embodiments generally relate to a method using floatable offshore buoyant vessels, platforms, caissons, buoys, spars, or other structures used for supporting offshore oil and gas operations.

BACKGROUND

Stable offshore depots for supporting offshore oil and gas operations are known in the art. Offshore production structures, which can be vessels, platforms, caissons, buoys, or spars, for example, each typically, include a buoyant hull that supports a superstructure. The buoyant hull includes internal compartmentalization for ballasting and storage, and the superstructure provides drilling and production equipment, helipads, crew living quarters, and the like.

In offshore work, on drilling and production platforms for example, a major operating cost arises from the transportation of support and supplies from on-shore facilities. Nearly everything must be carried by boat or by air. Such supply lines are subject to adverse weather and sea states, which have greater effect the farther the supplies must travel.

Accordingly, stable floating structures designed to be towed out to sea and moored close to several production platforms within a given field are known in the art. These structures may be used to provide shelter for transportation vessels and to provide support facilities, including storage, maintenance, firefighting, medical, and berthing facilities. Offshore bases, depots, or terminals may provide a reduction in platform operating costs, as they would allow safer and more cost effective transport of personnel and be supplied from the shore, which can be temporarily staged and distributed to local platforms. Prior art includes floating offshore support structure, which include a sheltered interior for receiving boats.

A floating structure is subject to environmental forces of wind, waves, ice, tides, and current. These environmental forces result in accelerations, displacements and oscillatory motions of the structure. The response of a floating structure to such environmental forces is affected not only by its hull design and superstructure, but also by its mooring system and any appendages. Accordingly, a floating structure has several design requirements: Adequate reserve buoyancy to safely support the weight of the superstructure and payload, stability under all conditions, and good seakeeping characteristics. With respect to the good seakeeping requirement, the ability to reduce vertical heave is very desirable. Heave motions can create tension variations in mooring systems, which can cause fatigue and failure. Large heave motions increase danger in launching and recovery of small boats and helicopters and loading and offloading stores and personnel.

The seakeeping characteristics of a floatable offshore depot are influenced by a number of factors, including the waterplane area, the hull profile, and the natural period of motion of the floating structure. It is very desirable that the natural period of the floating structure be either significantly greater than or significantly less than the wave periods of the sea in which the structure is located, so as to decouple substantially the motion of the structure from the wave motion.

Vessel design involves balancing competing factors to arrive at an optimal solution for a given set of factors. Cost, constructability, survivability, utility, and installation concerns are among many considerations in vessel design. Design parameters of the floating structure include the draft, the waterplane area, the draft rate of change, the location of the center of gravity ("CG"), the location of the center of buoyancy ("CB"), the metacentric height ("GM"), the sail area, and the total mass.

The total mass includes added mass i.e., the mass of the water around the buoyant hull of the floating structure that is forced to move as the floating structure moves. Appendages connected to the structure of the buoyant hull for increasing added mass are a cost effective way to fine tune structure response and performance characteristics when subjected to the environmental forces.

Several general naval architecture rules apply to the design of an offshore vessel. The waterplane area is directly proportional to induced heave force. A structure that is symmetric about a vertical axis is generally less subject to yaw forces. As the size of the vertical hull profile in the wave zone increases, wave-induced lateral surge forces also increase. A floating structure may be modeled as a spring with a natural period of motion in the heave and surge directions. The natural period of motion in a particular direction is inversely proportional to the stiffness of the structure in that direction. As the total mass (including added mass) of the structure increases, the natural periods of motion of the structure become longer.

One method for providing stability is by mooring the structure with vertical tendons under tension, such as in tension leg platforms. Such platforms are advantageous, because they have the added benefit of being substantially heave restrained. However, tension leg platforms are costly structures and, accordingly, are not feasible for use in all situations.

Self-stability (i.e., stability not dependent on the mooring system) may be achieved by creating a large waterplane area. As the structure pitches and rolls, the center of buoyancy of the submerged hull shifts to provide a righting moment. Although the center of gravity may be above the center of buoyancy, the structure can nevertheless remain stable under relatively large angles of heel. However, the heave seakeeping characteristics of a large waterplane area in the wave zone are generally undesirable.

Inherent self-stability is provided when the center of gravity is located below the center of buoyancy. The combined weight of the superstructure, buoyant hull, payload, ballast and other elements may be arranged to lower the center of gravity, but such an arrangement may be difficult to achieve. One method to lower the center of gravity is the addition of fixed ballast below the center of buoyancy to counterbalance the weight of superstructure and payload. Structural fixed ballast such as pig iron, iron ore, and concrete, are placed within or attached to the buoyant hull structure. The advantage of such a ballast arrangement is that stability may be achieved without adverse effect on seakeeping performance due to a large waterplane area.

Self-stable structures have the advantage of stability independent of the function of mooring system. Although the heave seakeeping characteristics of self-stabilizing floating structures are generally inferior to those of tendon-based platforms, self-stabilizing structures may nonetheless be preferable in many situations due to higher costs of tendon-based structures.

Prior art floating structures have been developed with a variety of designs for buoyancy, stability, and seakeeping characteristics. An apt discussion of floating structure design considerations and illustrations of several exemplary floating structures are known in the industry.

Various spar buoy designs as examples of inherently stable floating structures in which the center of gravity ("CG") is disposed below the center of buoyancy ("CB"). Spar buoy hulls are elongated, typically extending more than six hundred feet below the water surface when installed. The longitudinal dimension of the buoyant hull must be great enough to provide mass such that the heave natural period is long, thereby reducing wave-induced heave. However, due to the large size of the spar hull, fabrication, transportation, and installation costs are increased. It is desirable to provide a structure with integrated superstructure that may be fabricated quayside for reduced costs, yet which still is inherently stable due to a center of gravity located below the center of buoyancy.

Prior art discloses an offshore platform that employs a retractable center column. The center column is raised above the keel level to allow the platform to be pulled through shallow waters en-route to a deep water installation site. At the installation site, the center column is lowered to extend below the keel level to improve vessel stability by lowering the center of gravity. The center column also provides pitch damping for the structure. However, the center column adds complexity and cost to the construction of the platform.

Other offshore system hull designs are known in the art. Octagonal hull structures with sharp corners and steeply sloped sides to cut and break ice for arctic operations of a vessel. Unlike most conventional offshore structures, which are designed for reduced motions, Srinivasan's structure is designed to induce heave, roll, pitch and surge motions to accomplish ice cutting.

Drilling and production platforms with a cylindrical hull, wherein the structure has a center of gravity located above the center of buoyancy and therefore relies on a large waterplane area for stability, with a concomitant diminished heave seakeeping characteristic. Although, the structure has a circumferential recess formed about the buoyant hull near the keel for pitch and roll damping, the location and profile of such a recess has little effect in dampening heave.

It is believed that none of the offshore structures of prior art, in particular offshore depots or terminals that are arranged to provide shelter to the boats that are used for transportation of supplies and personnel to offshore platforms, are characterized by all of the following advantageous attributes: Symmetry of the buoyant hull about a vertical axis; the center of gravity located below the center of buoyancy for inherent stability without the requirement for complex retractable columns or the like, exceptional heave damping characteristics without the requirement for mooring with vertical tendons, and the ability for quayside integration of the superstructure and "right-side-up" transit to the installation site, including the capability for transit through shallow waters. An offshore depot or terminal possessing these entire characteristics is desirable.

It is believed that none of the offshore structures of prior art, in particular offshore depots or terminals that are arranged to provide shelter to the boats that used for transportation of supplies and personnel to offshore platforms, are characterized by all of the following advantageous attributes: Symmetry of the buoyant hull about a vertical axis, the center of gravity located below the center of buoyancy for inherent stability without the requirement for complex retractable columns or the like, exceptional heave damping characteristics without the requirement for mooring with vertical tendons, and the ability for quayside integration of the superstructure and "right-side-up" transit to the installation site, including the capability for transit through shallow waters. An offshore depot or terminal possessing these entire characteristics is desirable.

A need exists for an offshore depot that provides kinetic energy absorption capabilities from a watercraft by providing a plurality of dynamic movable tendering mechanisms in a tunnel formed in the offshore depot.

A further need exists for an offshore depot that provides wave damping and wave breakup within a tunnel formed in the offshore depot.

A need exists for an offshore depot that provides friction forces to a buoyant hull of a watercraft in the tunnel.

The present embodiments meet these needs.

BRIEF DESCRIPTION OF THE DRAWINGS

The detailed description will be better understood in conjunction with the accompanying drawings as follows:

FIG. 9 depicts a horizontal cross section taken through the buoyant hull of the floatable offshore depot showing a straight tunnel formed completely there through.

Figure 1:
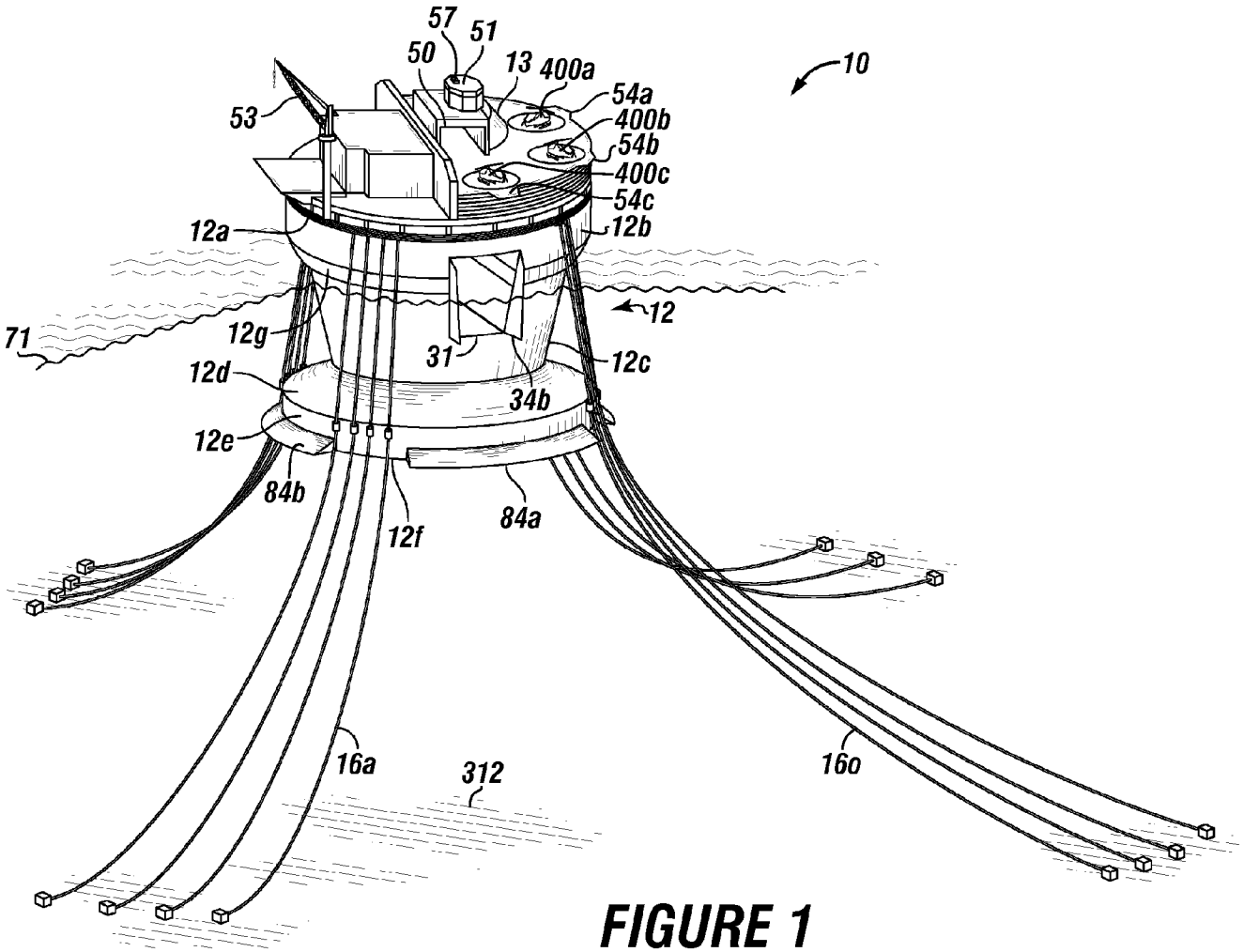
FIG. 1 depicts a perspective view of a floatable offshore depot moored to the seabed according to one or more embodiments.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments relate to a method using a floatable offshore depot for supporting offshore oil and gas operations.

The current method relates to a stable moored floatable offshore depot, such as would be used for safe handling, staging, and transportation of personnel, supplies, boats, and helicopters The embodiments of the method enable safe entry of a watercraft into the floatable offshore depot in both harsh and benign offshore water environments, with 4 foot to 40 foot seas.

The embodiments of the method prevent injuries to personnel from equipment falling off the floatable offshore depot by providing a tunnel to contain and protect watercraft for receiving personnel within the floatable offshore depot.

The embodiments of the method provide the floatable offshore depot located in an offshore field that enables a quick exit from the offshore structure by many personnel simultaneously, in the case of an approaching hurricane, tsunami, or any other natural disaster.

The embodiments of the method provide a means to quickly transfer many personnel, such as from 200 people to 500 people safely from an adjacent platform on fire to the floatable offshore depot in less than 1 hour.

The embodiments of the method enable the floatable offshore structure to be towed to an offshore disaster and operate as a command center to facilitate in the control of a disaster, and can act as a hospital or triage center.

The embodiments relate to a method using the floatable offshore depot to provide a sheltered area using a tunnel for safe and easy launching/docking of watercraft and for safe and easy embarkation/debarkation of personnel using an internal dock side of a tunnel.

The additional uses of the floatable offshore depot provide a sheltered area using a tunnel for transferring equipment between a watercraft and the floatable offshore depot.

The floatable offshore depot can have an internal dock side of tunnel.

The floatable offshore depot can have a buoyant hull that can be circular, oval, elliptical, or polygonal.

The floatable offshore depot can have: a keel; a main deck; and at least two connected sections between the keel and the main deck. The at least two connected sections can be joined in a series and symmetrical about a vertical axis.

The at least two connected sections can extend downwardly from the main deck toward the keel. The connected sections can have at least two of: an upper cylindrical side section, a transition section, and a lower cylindrical section. The tunnel, when the floatable offshore depot can be at an operational depth, can have a tunnel opening to an exterior of the buoyant hull. The tunnel can be dimensioned to receive a watercraft.

The watercraft can be a ferry, a workboat, a vessel up to 600 feet in length with or without propulsion, such as a barge. The watercraft can also be a submarine. The watercraft can have different buoyant hull shapes, such as catamaran, trimaran, monohull, hovercraft, or even a hydrofoil. The tunnel can receive a dirigible, also known as a ZEPPLIN™.

Now turning to the Figures, FIG. 1 illustrates the floatable offshore depot 10 for operationally supporting offshore exploration, drilling, production, and storage installations according to one or more embodiments.

The floatable offshore depot 10 is shown floating moored to a seabed 312. The floatable offshore depot includes a buoyant hull 12, which can carry a superstructure 13 thereon. The superstructure 13 can include a diverse collection of equipment and structures, such as living quarters for a crew, equipment storage, a heliport, and a myriad of other structures, systems, and equipment, depending on the type of offshore operations to be supported. At least one crane 53 can be mounted to the superstructure 13. The buoyant hull 12 can be moored to the seabed by a plurality of catenary mooring lines 16*a*-16*o*.

The superstructure 13 is shown supporting at least one take-off and landing surface 54*a* and 54*b*. The at least one take-off and landing surface 54*a* and 54*b* is shown as a heliport. The superstructure 13 can include an aircraft hangar 50. In embodiments, the aircraft hangar can hold at least one take-off and landing aircraft 400*a*, 400*b*, and 400*c*. A control tower 51 can be built on the superstructure 13. The control tower can have a dynamic positioning system 57.

In this embodiment of the method, the floatable offshore depot 10 can have a tunnel opening 31 for a tunnel formed in the buoyant hull 12.

The tunnel opening 31 can receive water while the floatable offshore depot 10 can be at an operational depth 71.

The floatable offshore depot 10 can have at least one closable door 34*b*.

In embodiments of the method, the tunnel can be constructed to provide for selective isolation of said tunnel from said exterior; whereby the tunnel can be operable in either a wet condition or a dry condition while the floatable offshore depot 10 floats in a body of water.

The floatable offshore depot 10 can have a unique shape.

The buoyant hull 12 of the floatable offshore depot 10 can have a main deck 12*a*, which can be circular; and a height H. Extending downwardly from the main deck 12*a* can be an upper frustoconical portion (shown as a combination of components).

In embodiments of the method, the upper frustoconical portion can have an upper cylindrical side section 12*b*. In further embodiments, the upper cylindrical side section 12*b* can extend downwardly from main deck 12*a*.

The floatable offshore depot 10 also can have a lower frustoconical side section 12*d* extending downwardly from the upper conical section 12*c* which can flare outwardly. Both the upper conical section 12*c* and the lower frustoconical side section 12*d* can be below the operational depth 71.

The upper cylindrical side section 12*b* can connect to a transition section 12*g*.

A lower cylindrical section 12*e* can extend downwardly from the lower frustoconical side section 12*d*, which can have a matching keel 12*f*.

The floatable offshore depot 10 can have at least one fin-shaped appendage 84*a* and 84*b*.

In embodiments of the method, the floatable offshore depot 10 can be configured to transition from a floating orientation having the floating operational depth 71 or a floating transit depth.

In embodiments of the method, the floatable offshore depot can be a seagoing vessel.

Figure 2:
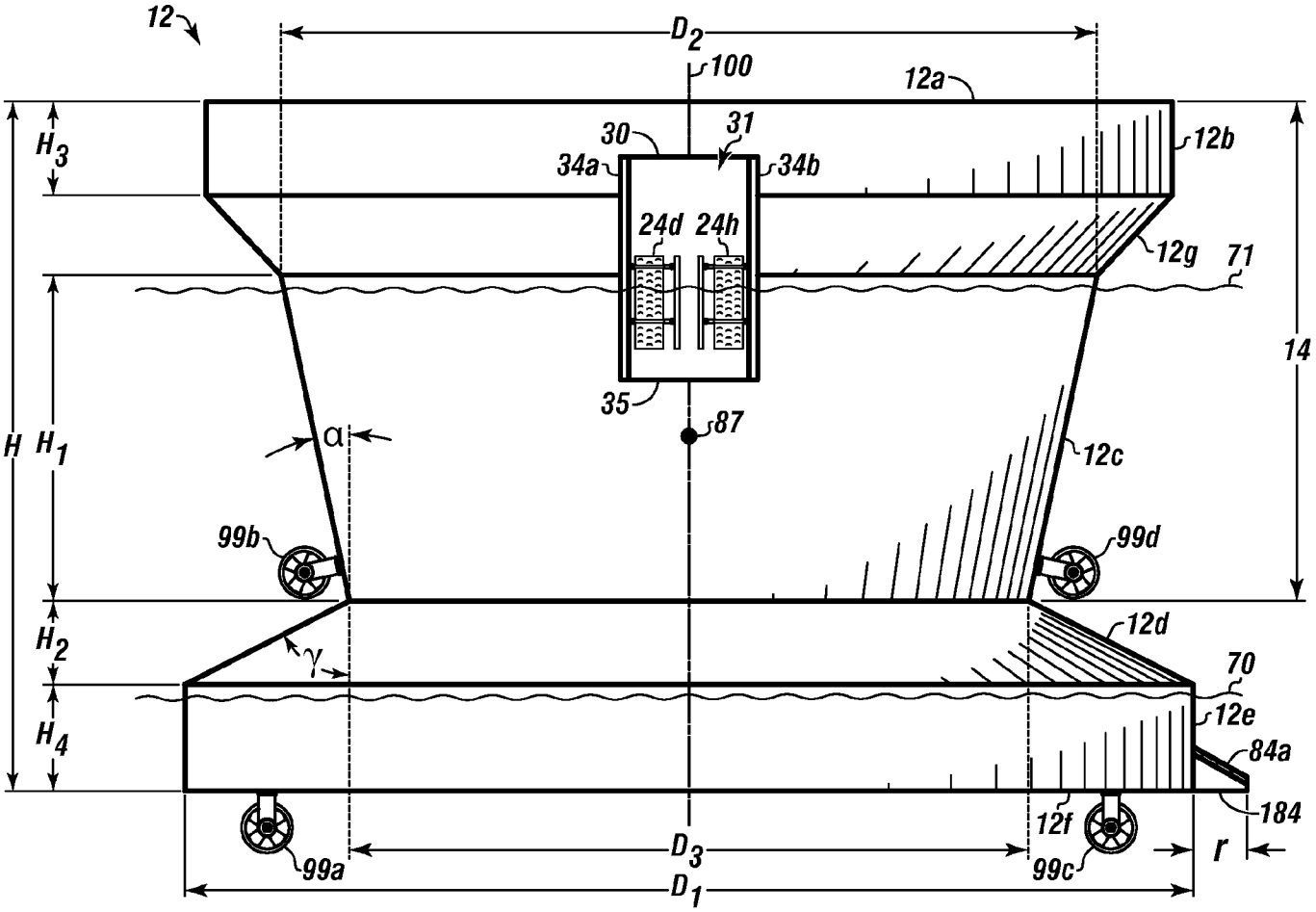
FIG. 2 depicts an axial cross-sectional drawing of the buoyant hull profile of the floatable offshore depot according to one or more embodiments.

FIG. 2 shows that the upper conical section 12*c* can have a substantially greater vertical height H1 than the lower frustoconical section 12*d* shown as H2. The upper cylindrical side section 12*b* can have a slightly greater vertical height H3 than the lower cylindrical section 12*e* shown as H4.

The upper cylindrical side section 12*b* can connect to transition section 12*g* so as to provide for a main deck of greater radius than the hull radius and a main deck which can be round, square, or another shape. Transition section 12*g* can be located above the operational depth 71.

A tunnel 30 can have the at least one closable door 34*a* and 34*b* that alternatively or in combination, can provide for weather and water protection to the tunnel 30.

Fin-shaped appendage 84 can be attached to a lower and an outer portion of the exterior of the buoyant hull.

The tunnel 30 can have a plurality of dynamic movable tendering mechanisms 24*d* and 24*h* disposed within and connected to tunnel sides.

The tunnel can have a tunnel floor 35 that can accept water when the floatable offshore depot can be at the operational depth 71.

The tunnel floor 35 enables creation of a dry dock environment within the buoyant hull 12 when the tunnel 30 can be drained of water.

The plurality of dynamic movable tendering mechanisms 24*d* and 24*h* can be oriented above the tunnel floor 35 and can have portions that can be positioned both above the operational depth 71 and extend below the operational depth 71 inside the tunnel 30.

In an embodiment of the method, the at least one closable door 34*a* and 34*b* can close over the tunnel opening 31.

The main deck 12*a*, the upper cylindrical side section 12*b*, the transition section 12*g*, the upper conical section 12*c*, the lower frustoconical side section 12*d*, the lower cylindrical section 12*e*, and a matching keel 12*f* can be all co-axial with a common vertical axis 100. In embodiments, the buoyant hull 12 can be characterized by an ellipsoidal cross section when taken perpendicular to the vertical axis 100 at any elevation.

Due to its ellipsoidal planform, the dynamic response of the buoyant hull 12 can be independent of wave direction (when neglecting any asymmetries in the mooring system, risers, and underwater appendages), thereby minimizing wave-induced yaw forces.

Additionally, the conical form of the buoyant hull 12 can be structurally efficient, offering a high payload and storage volume per ton of steel when compared to traditional ship-shaped offshore structures. The buoyant hull 12 can have ellipsoidal walls which can be ellipsoidal in radial cross-section, but such shape can be approximated using a large number of flat metal plates rather than bending plates into a desired curvature. Although an ellipsoidal hull planform is preferred, a polygonal hull planform can be used according to alternative embodiments.

In embodiments of the method, the buoyant hull 12 can be circular, oval, or elliptical forming the ellipsoidal planform.

An elliptical shape can be advantageous when the floatable offshore depot can be moored closely adjacent to another offshore platform so as to allow gangway passage between the two structures. An elliptical hull can minimize or eliminate wave interference.

The specific design of the upper conical section 12*c* and the lower frustoconical side section 12*d* generates a significant amount of radiation damping resulting in almost no heave amplification for any wave period, as described below.

The upper conical section 12*c* can be located in the wave zone. At operational depth 71, the waterline can be located on the upper conical section 12*c* just below the intersection with the upper cylindrical side section 12*b*. The upper conical section 12*c* can slope at an angle (cc) with respect to the vertical axis 100 from 10 degrees to 15 degrees. The inward flare before reaching the waterline can significantly dampen downward heave, because a downward motion of the buoyant hull 12 increases the waterplane area. In other words, the buoyant hull area normal to the vertical axis 100 that breaks the water's surface will increase with downward hull motion, and such increased area can be subject to the opposing resistance of the air and or water interface. It has been found that from 10 degrees to 15 degrees of flare provides a desirable amount of damping of downward heave without sacrificing too much storage volume for the vessel.

Similarly, the lower frustoconical side section 12*d* dampens upward heave. The lower frustoconical side section 12*d* can be located below the wave zone (about 30 meters below the waterline). Because the entire lower frustoconical side section 12*d* can be below the water surface, a greater area (normal to the vertical axis 100) can be desired to achieve upward damping. Accordingly, the first diameter $D_1$ of the lower hull section can be greater than the second diameter $D_2$ of the upper conical section 12*c*.

The lower frustoconical side section 12*d* can slope at an angle ($\gamma$) with respect to the vertical axis 100 from 55 degrees to 65 degrees. The lower section can flare outwardly at an angle greater than or equal to 55 degrees to provide greater inertia for heave roll and pitch motions. The increased mass contributes to natural periods for heave pitch and roll above the expected wave energy.

The upper bound of 65 degrees can be based on avoiding abrupt changes in stability during initial ballasting on installation. That is, the lower frustoconical side section 12*d* can be perpendicular to the vertical axis 100 and achieve a desired amount of upward heave damping, but such a hull profile would result in an undesirable step-change in stability during initial ballasting on installation. The connection point between the upper frustoconical portion 14 and the lower frustoconical side section 12*d* can have a third diameter $D_3$ smaller than the first diameter $D_1$ and second diameters $D_2$.

The floating transit depth 70 represents the waterline of the buoyant hull 12 while it is being transited to an operational offshore position. The floating transit depth is known in the art to reduce the amount of energy required to transit a buoyant vessel across distances on the water by decreasing the profile of floating offshore depot which contacts the water. The floating transit depth can be roughly the intersection of lower frustoconical side section 12*d* and lower cylindrical section 12*e*. However, weather and wind conditions can provide need for a different floating transit depth to meet safety guidelines or to achieve a rapid deployment from one position on the water to another.

The addition of a ballast to the buoyant hull 12 can be used to lower the center of gravity. In embodiments, the floatable offshore depot can have the buoyant hull with a low center of gravity 87, the low center of gravity providing an inherent stability to the structure.

In embodiments of the method, the buoyant hull can be characterized by a positive metacenter.

The floatable offshore depot aggressively resists roll and pitch and can be said to be "stiff." Stiff vessels can be typically characterized by abrupt jerky accelerations as the large righting moments counter pitch and roll. In particular, the orientation of the fixed ballast or fluid ballast increases the natural period of the floatable offshore depot to above the period of the most common waves, thereby limiting wave-induced acceleration in all degrees of freedom.

In an embodiment of the method, the floatable offshore depot can have a plurality of thrusters 99*a*, 99*b*, 99*c*, and 99*d* for use with dynamic positioning.

In embodiments, the fin-shaped appendage 84*a* can have the shape of a right triangle in a vertical cross-section, where the right angle can be located adjacent a lower most outer side wall of the lower cylindrical section 12*e* of the buoyant hull 12, such that a bottom edge 184 of the triangle shape can be co-planar with a matching keel 12*f*.

In embodiments, a hypotenuse of the triangle shape can extend from a distal end of the bottom edge 184 of the triangle shape upwards and inwards to attach to the outer side wall of the lower cylindrical section 12*e*.

The number, size, and orientation of the at least one fin-shaped appendage can be varied for optimum effectiveness in suppressing heave. For example, bottom edge 184 can extend radially outward a distance that can be about half the vertical height of the lower cylindrical section 12*e*, with the hypotenuse attaching to the lower cylindrical section 12*e* about one quarter up the vertical height of the lower cylindrical section 12*e* from keel level.

Alternatively, with the radius (r) of the lower cylindrical section 12*e* defined as the first diameter $D_1$ then the bottom edge 184 of the at least one fin-shaped appendage 84*a* can extend radially outwardly. Although the at least one fin-shaped appendage 84*a* is shown, defining a given radial coverage, a plurality of fin-shaped appendages defining more or less radial coverage can be used to vary the amount of added mass as required. Added mass can be desirable depending upon the requirements of a particular floating structure. Added mass however, can be generally the least expensive method of increasing the mass of a floating structure for purposes of influencing the natural period of motion.

Figure 3:
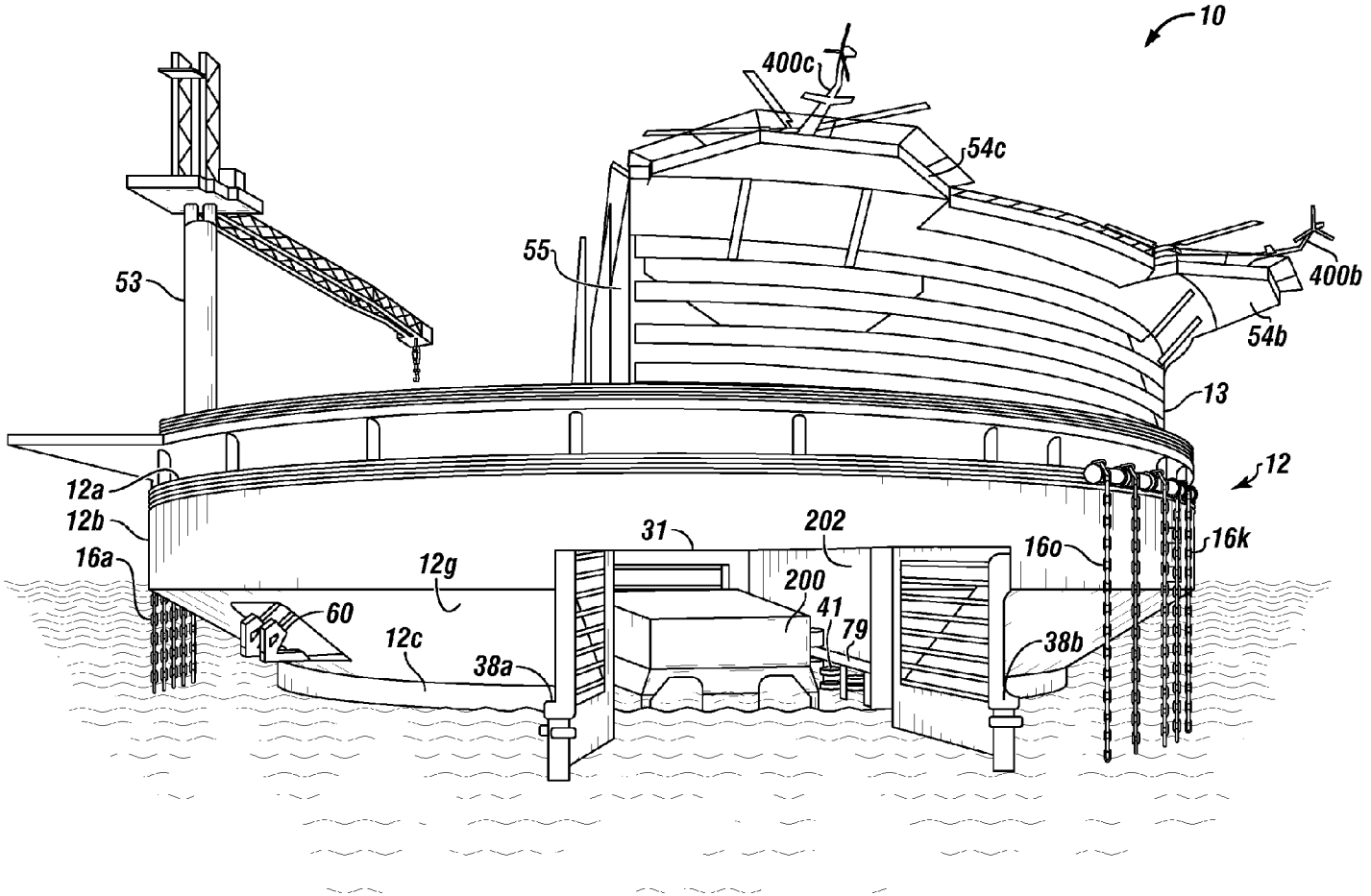
FIG. 3 depicts an enlarged perspective view of the floatable offshore depot showing detail of the tunnel, tunnel doors, and a small personnel transfer boat.

FIG. 3 shows the floatable offshore depot 10 with the main deck 12*a* and the superstructure 13 over the main deck.

The at least one crane 53 is shown mounted to the superstructure 13. The floatable offshore depot 10 can include the at least one take-off and landing surface 54*b* and 54*c*, such as heliports which enable the at least one take-off and landing aircraft 400*b* and 400*c*, such as a plurality of helicopters or similar take-off and landing aircraft, to take off and land simultaneously on the plurality of take-off and landing surfaces, instead of sequentially.

The term "aircraft" as used herein can be helicopters, short takeoff and landing craft, dirigibles, drones, balloons, and similar craft. In embodiments, the aircraft can be remote controlled.

In embodiments of the method, the at least one take-off and landing surfaces 54*b* and 54*c* can each be mounted on pedestals extending from the buoyant hull of the floating offshore depot. In further embodiments, a pedestal can support the at least one take-off and landing surface 54*b* and 54*c*.

In embodiments of the method, the at least one take-off and landing surfaces 54*b* and 54*c*, can be mounted to the main deck 12*a* or transitioned through the superstructure 13 in part or in whole, such as an overhang or a supported overhang supported on the main deck 12*a*.

In this view, a watercraft 200 is in the tunnel having come into the tunnel through the tunnel opening 31 and is positioned between the tunnel sides, of which a first tunnel side 202 is labeled. A boat lift 41 is also shown in the tunnel, which can raise the watercraft above the operational depth in the tunnel.

The tunnel opening 31 is shown with two doors, each door having at least one door fender 38*a* and 38*b* for mitigating damage to a watercraft attempting to enter the tunnel, but not hitting the doors.

In embodiments of the method, the floatable offshore depot 10 can have the at least one door fender 38*a* and 38*b* positioned at a location that is either: (i) within the tunnel to reduce wave action and provide clearance guidance to the watercraft or (ii) outside the tunnel opening 31 enabling self-guiding of the watercraft 200 into the tunnel or at both locations (i) and (ii) simultaneously while reducing wave action.

The at least one door fender 38*a* and 38*b* can allow the watercraft 200 to impact the at least one door fender 38*a* and 38*b* safely if the pilot cannot enter the tunnel directly due to at least one of large wave and high current movement from a location exterior of the buoyant hull 12.

The floatable offshore depot 10 can have at least one self-guiding stabbing dock shape 79.

The plurality of catenary mooring lines 16*a*-16*o* are shown coming from the main deck 12*a*.

A berthing facility 60 is shown in the buoyant hull 12 in the portion of the transition section 12*g*.

The transition section 12*g* is shown connected to the upper conical section 12*c* and the upper cylindrical side section 12*b*.

Accommodations 55 are also shown on the superstructure.

Figure 4A:
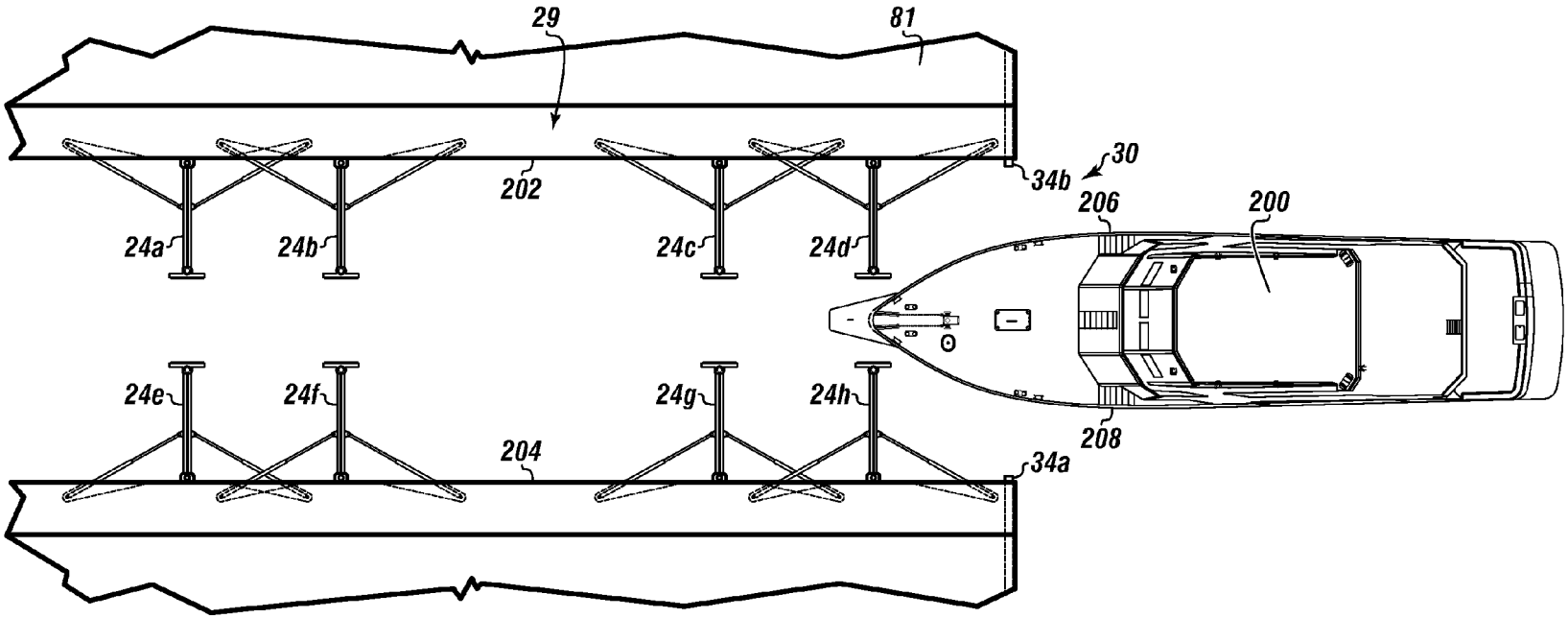
FIG. 4A depicts a top view of a plurality of dynamic moveable tendering mechanisms in a tunnel before a watercraft has contacted the dynamic moveable tendering mechanisms.

FIG. 4A shows the watercraft 200 entering the tunnel 30 between the first tunnel side 202 and a second tunnel side 204 and connecting to the plurality of dynamic movable tendering mechanisms 24*a*-24*h*. Proximate to the tunnel opening can be closable doors 34*a* and 34*b* which can be sliding pocket doors to provide either a weathertight or watertight protection of the tunnel from the exterior environment. A starboard side 206 hull of the watercraft and a port side 208 hull of the watercraft are also shown.

FIG. 4A shows the tunnel 30 for safe and easy launching/docking of watercraft 200 and embarkation/debarkation of personnel having an internal dock side 29 which allows personnel to step off, like a dock, or equipment to be stored.

The tunnel 30 is also depicted with a lower tapering surface 81 which can create a "beach like" effect rising out of the water. Also depicted is the watercraft 200 inside a portion of the tunnel between the first tunnel side 202 and the second tunnel side 204 and connecting to the plurality of dynamic movable tendering mechanisms 24*a*-24*h*.

The at least one closable door 34*a* and 34*b* are also shown along with the watercraft having the port side 208 and the starboard side 206.

Figure 4B:
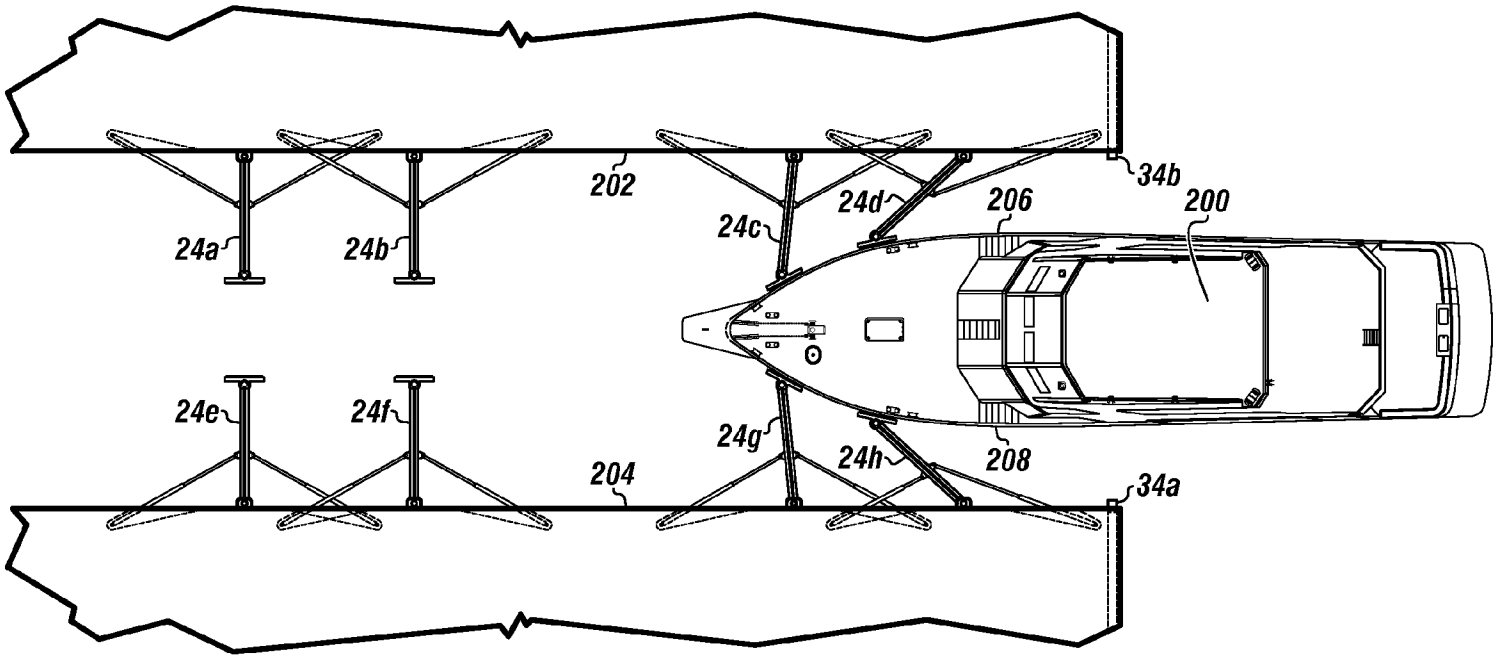
FIG. 4B depicts a top view of a plurality of dynamic moveable tendering mechanisms in a tunnel as the watercraft contacts the dynamic moveable tendering mechanisms.

FIG. 4B shows the watercraft 200 inside a portion of the tunnel between the first tunnel side 202 and the second tunnel side 204 and connecting to the plurality of dynamic movable tendering mechanisms 24*a*-24*h*.

The plurality of dynamic moveable tendering mechanisms 24*g* and 24*h* are shown contacting the port side 208 hull of the watercraft 200. Dynamic moveable tendering mechanisms 24*c* and 24*d* are seen contacting the starboard side 206 hull of the watercraft 200. The at least one closable door 34*a* and 34*b* are also shown.

Figure 4C:
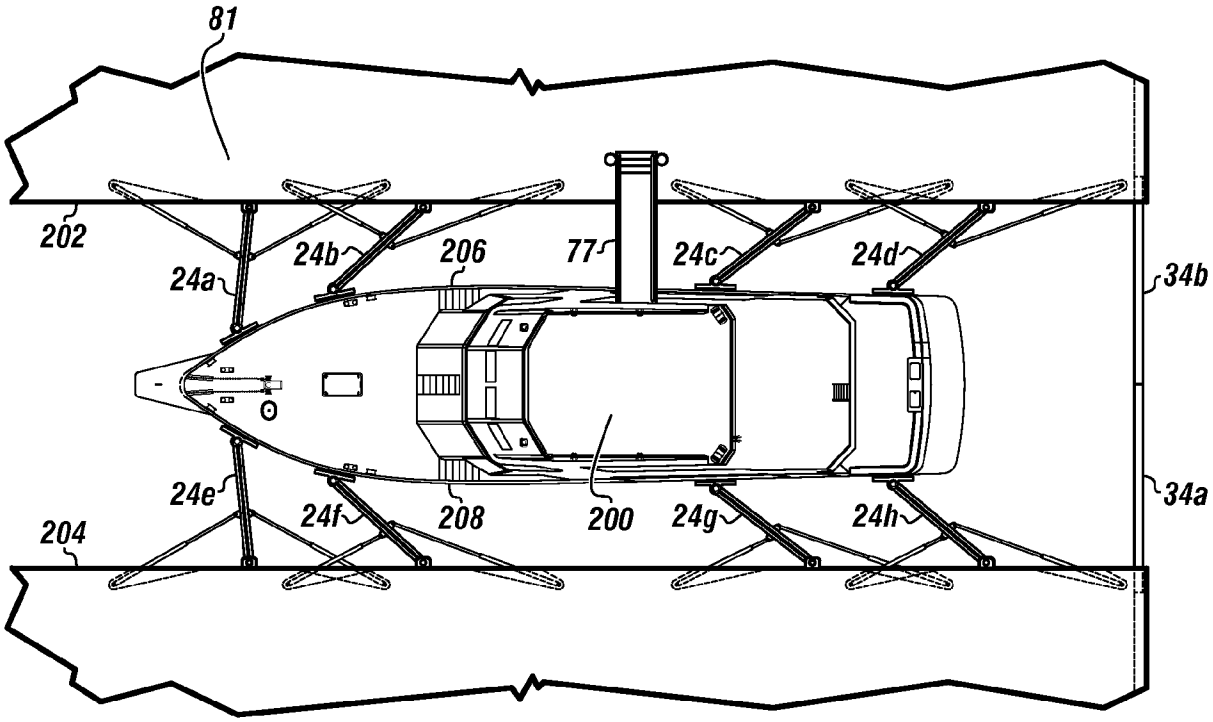
FIG. 4C depicts a top view of a plurality of dynamic moveable tendering mechanisms in a tunnel connecting to the watercraft with the doors closed.

FIG. 4C shows the watercraft 200 in the tunnel between the first tunnel side 202 and the second tunnel side 204 and connecting to the plurality of dynamic movable tendering mechanisms 24*a*-24*h* and also connected to a gangway 77.

Proximate to the tunnel opening can be the at least one closable door 34*a* and 34*b* which can be sliding pocket doors oriented in a closed position providing either a weathertight or watertight protection of the tunnel from the exterior environment. The plurality of the dynamic moveable tendering mechanisms 24*a*-24*h* are shown in contact with the buoyant hull of the watercraft on both the starboard side 206 and the watercraft port side 208. A lower tapering surface 81 is also shown.

Figure 5A:
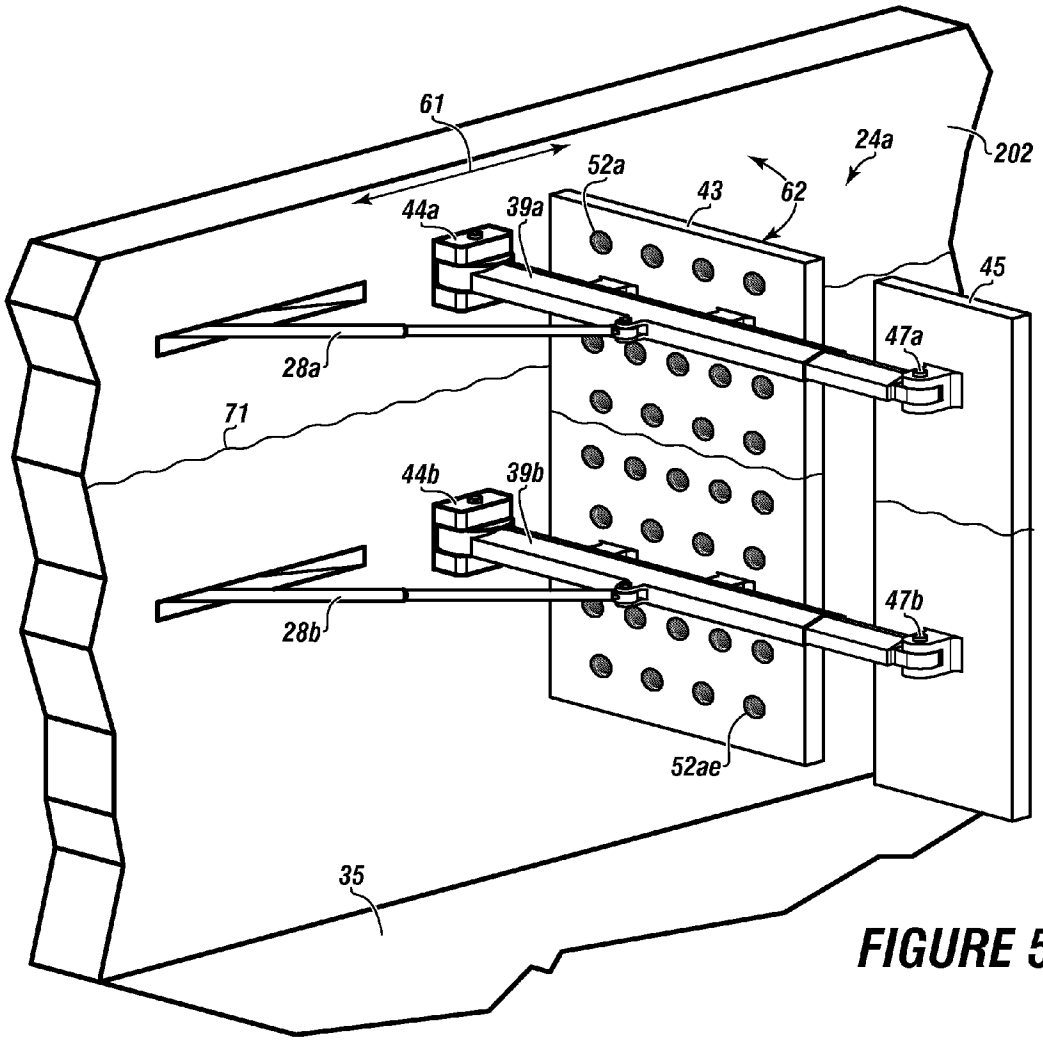
FIG. 5A depicts an elevated perspective view of one of the dynamic moveable tendering mechanisms.

FIG. 5A shows one of the plurality of the dynamic movable tendering mechanisms 24*a*. Each of the plurality of dynamic movable tendering mechanisms can have a pair of parallel arms 39*a* and 39*b* mounted to the first tunnel side or the second tunnel side.

At least one tunnel fender 45 can connect to the pair of parallel arms 39*a* and 39*b* on the sides of the parallel arms opposite the first tunnel side or the second tunnel side.

A plate 43 can be mounted to the pair of parallel arms 39*a* and 39*b* and between the at least one tunnel fender 45 and the first tunnel side 202.

The plate 43 can be mounted above the tunnel floor 35 and positioned to extend above an operational depth 71 in the tunnel and below the operational depth 71 in the tunnel simultaneously.

The plate 43 can be configured to dampen movement of the watercraft as the watercraft moves from side to side in the tunnel. The plate 43 and the entire plurality of the dynamic movable tendering mechanism can prevent damage to the ship hull, and push a watercraft away from a ship hull without breaking towards the tunnel center. The embodiments can allow a vessel to bounce in the tunnel without damage.

A plurality of pivot anchors 44*a* and 44*b* can connect one of the parallel arms 39*a* and 39*b* to either tunnel side 202 and 204.

Each of the plurality of pivot anchors 44*a* and 44*b* can enable the plate 43 to swing from a collapsed orientation against the tunnel sides to an extended orientation at an angle 62, which can be up to 90 degrees from a plane 61 of the wall enabling the plate 43 on the one of the pair of parallel arms 39*a* and 39*b* and the at least one tunnel fender 45 to simultaneously (i) shield the tunnel from waves and water sloshing effects, (ii) absorb kinetic energy of the watercraft as the watercraft moves in the tunnel, and (iii) apply a force to push against the watercraft keeping the watercraft away from the side of the tunnel.

A plurality of fender pivots 47*a* and 47*b* are shown, wherein each of the plurality of fender pivots 47*a* and 47*b* can form a connection between each of the parallel arms 39*a* and 39*b* and the at least one tunnel fender 45.

Each fender pivot can allow the fender to pivot from one side of the parallel arm to an opposite side of the parallel arm through at least 90 degrees as the watercraft contacts the at least one tunnel fender 45.

A plurality of openings 52*a*-52*ae* in the plate 43 can reduce wave action. Each of the plurality of openings 52*a*-52*ae* can have a diameter from 0.1 of a meter to 2 meters. In embodiments, the openings 52*a*-52*ae* can be ellipses.

At least one hydraulic cylinder 28*a* and 28*b* can be connected to each parallel arm for providing resistance to watercraft pressure on the fender and for extending and retracting the plate from the tunnel sides.

Figure 5C:
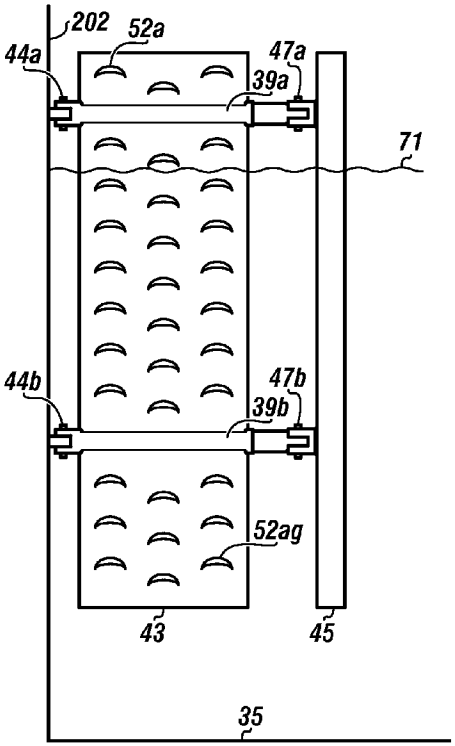
FIG. 5C depicts a side view of an embodiment of one of the dynamic moveable tendering mechanism.
Figure 5B:
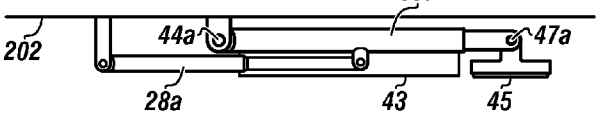
FIG. 5B depicts a collapsed top view of one of the dynamic moveable tendering mechanisms.

FIG. 5B shows one of the pair of parallel arms 39*a* mounted to a first tunnel side 202 in a collapsed position.

One of the pair of parallel arms 39*a* can be connected to one of a plurality of pivot anchors 44*a* that engages the first tunnel side 202.

At least one of the plurality of fender pivots 47*a* can be mounted on the one of the pair of parallel arms opposite the one of a plurality of pivot anchors 44*a*.

The at least one tunnel fender 45 can be mounted to the at least one of the plurality of fender pivots 47*a*.

The plate 43 can be attached to the one of the pair of parallel arms 39*a*.

The at least one hydraulic cylinder 28*a* can be attached to the parallel arm and the tunnel wall.

FIG. 5C shows the plate 43 with the plurality of openings 52*a*-52*ag* that can be ellipsoidal in shape. The plate 43 is shown mounted above the tunnel floor 35.

The plate 43 can extend both above and below the operational depth 71.

The first tunnel side 202, the plurality of pivot anchors 44*a* and 44*b*, the parallel arms 39*a* and 39*b*, the plurality of fender pivots 47*a* and 47*b*, the tunnel 30, and the at least one fender 45 is also shown.

Figure 5D:
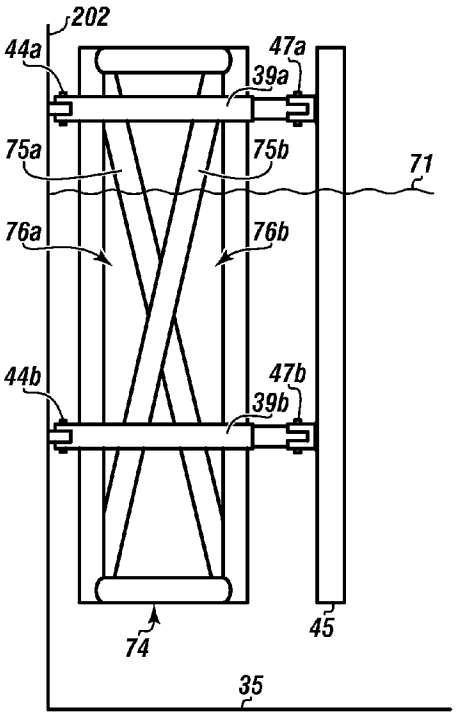
FIG. 5D depicts a side view of another embodiment of the dynamic moveable tendering mechanism.

FIG. 5D shows an embodiment of a dynamic moveable tendering mechanism formed from a frame 74 instead of the plate. The frame 74 can have a pair of intersecting tubulars 75*a* and 75*b* that form openings 76*a* and 76*b* for allowing water to pass while water in the tunnel is at an operational depth 71.

The first tunnel side 202, the tunnel floor 35, the plurality of pivot anchors 44*a* and 44*b*, the pair of parallel arms 39*a* and 39*b*, the plurality of fender pivots 47*a* and 47*b*, and the at least one tunnel fender 45 is shown.

Figure 6:
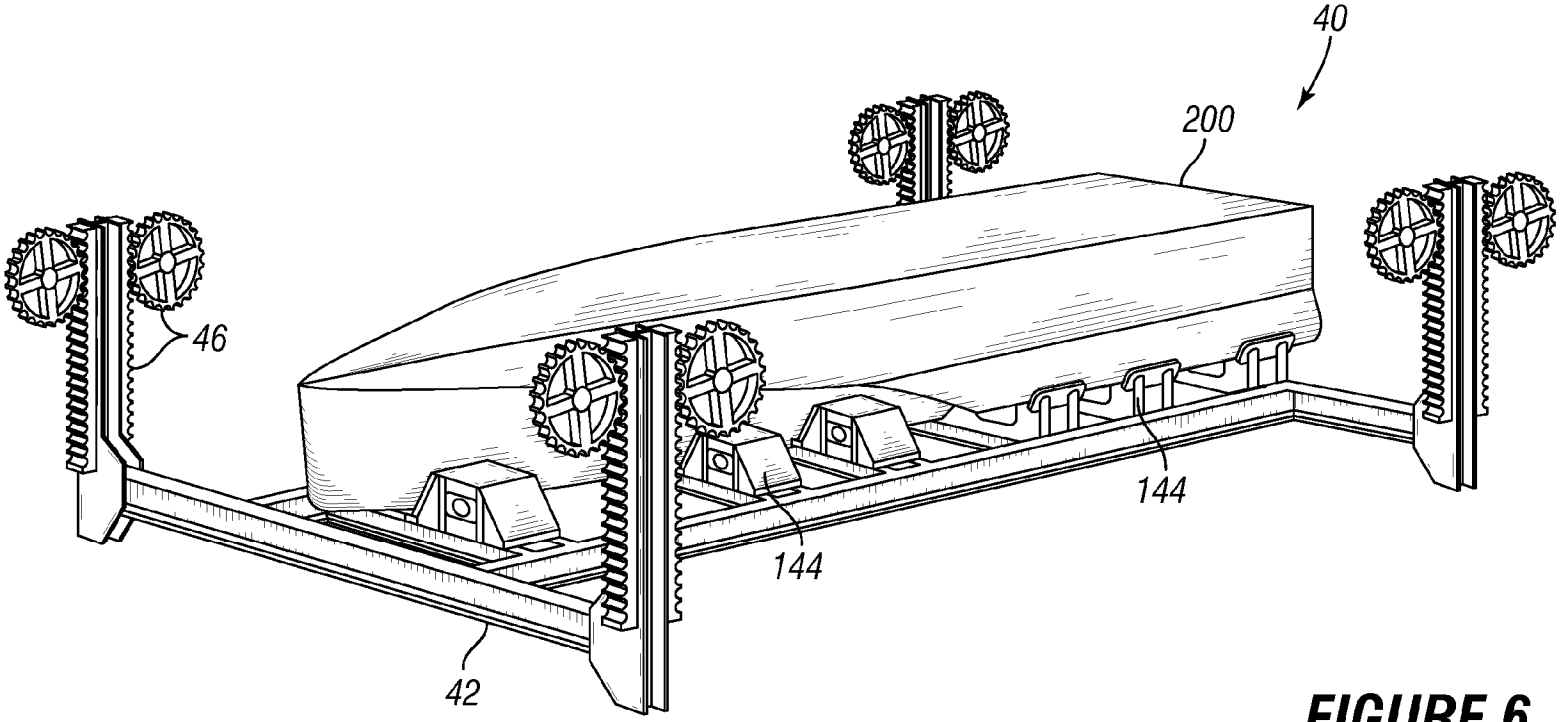
FIG. 6 depicts a perspective view of a boatlift assembly of the floatable offshore depot disposed within the tunnel.

FIG. 6 depicts a perspective view of a boatlift assembly of the floatable offshore depot disposed within the tunnel.

In one or more embodiments of the method, a boatlift assembly 40 can be disposed within tunnel.

The boatlift assembly 40 can include a boat lift assembly frame 42 carrying chocks 144 that can be positioned and arranged for supporting the watercraft 200. In an embodiment, the boatlift assembly frame 42 can be formed of I-beams in a rectangular shape, which can be approximately 15 meters by 40 meters with a safe working load from 200 tons to 300 tons.

The boatlift assembly frame 42 can be suitable for hoisting a fast transport unit ("FTU"), such as an aluminum water-jet-propulsion trimaran crew boat capable of transporting up to 200 persons with a transit speed of up to 40 knots. A drive assembly 46, which can include rack and pinion gearing, piston-cylinder arrangements, or a system of running rigging, for example, raises and lowers the boatlift assembly frame 42 with its payload. Boatlift assembly can be capable of lifting the watercraft 200 from 1 meter to 2 meters or more so as to eliminate any heave and roll of the watercraft 200 with respect to the floatable offshore depot, thereby establishing a safe condition in which to embark and debark passengers.

In embodiments of the method, high pressure air and/or water nozzles can be disposed at various points in tunnel below water in order to air raid the water column, thereby influencing the wave and the localized swell action within tunnel.

In alternative embodiments of the method, using an active boatlift assembly to raise the watercraft 200, the floatable offshore depot can be ballasted to lower its position in the water to allow the watercraft 200 to enter the tunnel. Once the watercraft 200 can be positioned above appropriate chocks, the floatable offshore depot can be deballasted, thereby raising the floatable offshore depot further out of the water, draining water from the tunnel, and causing the watercraft 200 to be seated in its chocks in a dry dock condition.

Figure 7:
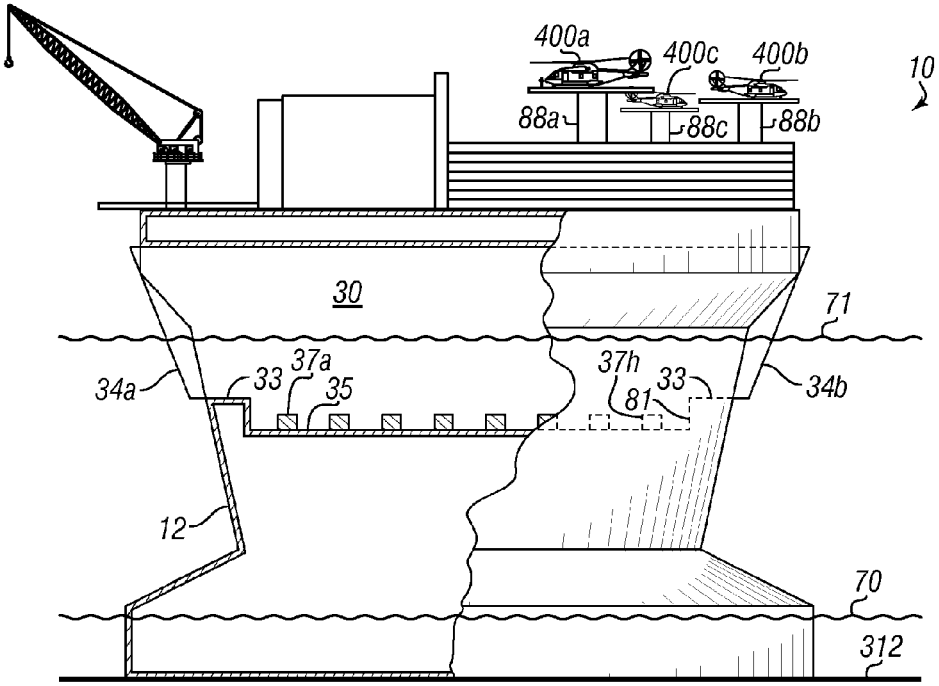
FIG. 7 depicts an elevation side view in partial cross section of the buoyant hull of the floatable offshore depot, showing baffles for reducing waves within the tunnel.

FIG. 7 depicts an elevation side view in partial cross section of the buoyant hull of the floatable offshore depot 10, showing a plurality of baffles 37*a*-37*h* for reducing waves within the tunnel 30.

The floatable offshore depot 10, which can be configured to be floatable to transition from a floating orientation having the floating operational depth 71 or a floating transit depth 70 to be in a ballasted orientation resting on a seabed 312.

Pedestals 88*a*, 88*b*, and 88*c* are depicted supporting the at least one take-off and landing surface, which can be mounted to the main deck or transitioned through the superstructure in part or in whole, such as an overhang or a supported overhang supported on the main deck. A plurality of take-off and landing aircraft 400*a*, 400*b*, and 400*c* are shown.

Thresholds 33 are depicted disposed at or near the entrances of the tunnel 30, which can reduce wave energy entering the tunnel 30. At least one of the plurality of baffles 37*a*-37*h* can be included on the tunnel floor 35 to further reduce the propensity for sloshing within the tunnel 30.

The tunnel 30 can be formed within or through buoyant hull 12 at the waterline. The tunnel 30 can provide a sheltered area inside the buoyant hull 12 for safe and easy launching/docking of boats and embarkation/debarkation of personnel. The tunnel 30 can have the lower tapering surface 81 that provides a "beach effect" that absorbs most of the surface wave energy at the tunnel entrance(s), thereby reducing slamming and harmonic effects on boats when traversing or moored within the tunnel 30. The tunnel 30 can optionally be part of or include a moon pool that opens through the matching keel 12*f*. The moon pool, if provided, can be open to the sea below, using grating to prevent objects from falling there through, for example, or it can be closeable by a watertight hatch, if desired. An open moon pool can provide slightly better overall motion response.

In embodiments of the method, the tunnel 30 can have, at every entrance, at least one closeable door. In embodiments the at least one closeable door can be watertight or weathertight, that can be opened and closed as required. The at least one closeable door 34*a* and 34*b* can also function as a guiding and stabbing system, because the at least one closeable door 34*a* and 34*b* can be fitted with robust rubber fenders to reduce potential damage to the buoyant hull 12 and the watercraft should impact occur. The interior of the tunnel 30 can include fenders to facilitate docking. When the at least one closeable door 34*a* and 34*b* is shut, the tunnel 30 with the tunnel floor 35 can be drained using, for example, a gravity based draining system or high capacity pumps located in the pump room of the floatable offshore depot, so as to create a dry dock environment within the buoyant hull 12. Weathertight doors, which can include openings below the waterline, can be used in place of watertight doors to allow controlled circulation of water between the tunnel 30 and the exterior. The at least one closeable door 34*a* and 34*b* can be hinged, or can slide vertically or horizontally as is known in the art.

The tunnel 30 can include a single branch or multiple branches with multiple penetrations through the buoyant hull 12. The tunnel 30 can include straight, curved, tapering sections and intersections in a variety of elevations and configurations.

Figure 8:
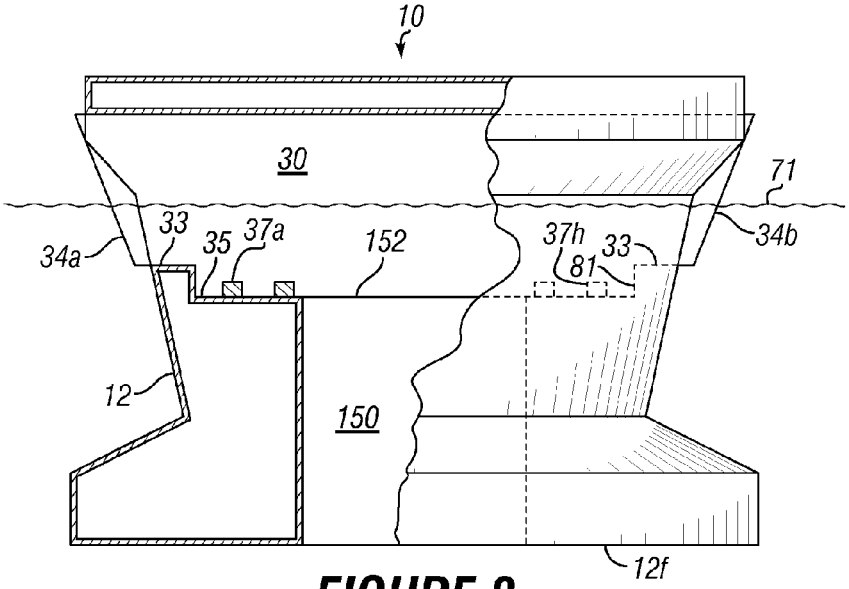
FIG. 8 depicts an elevation side view in partial cross section of the buoyant hull of the floatable offshore depot according to one or more embodiments.

FIG. 8 depicts an elevation side view in partial cross section of the buoyant hull of the floatable offshore depot showing a plurality of baffles 37*a*-37*h* for reducing waves within the tunnel 30.

The floatable offshore depot 10, which can be configured to be floatable to transition from a floating orientation having the floating operational depth 71.

The thresholds 33 are depicted disposed at or near the entrances of the tunnel 30, which can reduce wave energy entering the tunnel 30. At least one of the plurality of baffles 37*a*-37*h* can be included on the tunnel floor 35 to further reduce the propensity for sloshing within the tunnel 30.

In embodiments, the tunnel 30 can be formed within or through the buoyant hull 12 at the waterline. The tunnel 30 can provide a sheltered area inside the buoyant hull 12 for safe and easy launching/docking of boats and embarkation/debarkation of personnel. The tunnel 30 can have the lower tapering surface 81 that provides a "beach effect" that absorbs most of the surface wave energy at the tunnel entrance(s), thereby reducing slamming and harmonic effects on boats when traversing or moored within the tunnel 30. The tunnel 30 can optionally be part of or include the moon pool that can open through the matching keel 12*f*. In embodiments, the moon pool, if provided, can be open to the sea below, using grating 152 to prevent objects from falling there through, for example, or it can be closeable by a watertight hatch, if desired. An open moon pool can provide slightly better overall motion response.

In embodiments of the method, the tunnel 30 can have, at every entrance, at least one closeable door. In embodiments the at least one closeable door can be watertight or weathertight, that can be opened and closed as required. The at least one closeable door 34*a* and 34*b* can also function as a guiding and stabbing system, because the at least one closeable door 34*a* and 34*b* can be fitted with robust rubber fenders to reduce potential damage to the buoyant hull 12 and the watercraft should impact occur. The interior of the tunnel 30 can include fenders to facilitate docking. When the at least one closeable door 34*a* and 34*b* is shut, the tunnel 30 with the tunnel floor 35 can be drained using, for example, the gravity based draining system or high capacity pumps located in the pump room of the floatable offshore depot, so as to create a dry dock environment within the buoyant hull 12. Weathertight doors, which can include openings below the waterline, can be used in place of watertight doors to allow controlled circulation of water between the tunnel 30 and the exterior. The at least one closeable door 34*a* and 34*b* can be hinged, or can slide vertically or horizontally as is known in the art.

Figure 9:
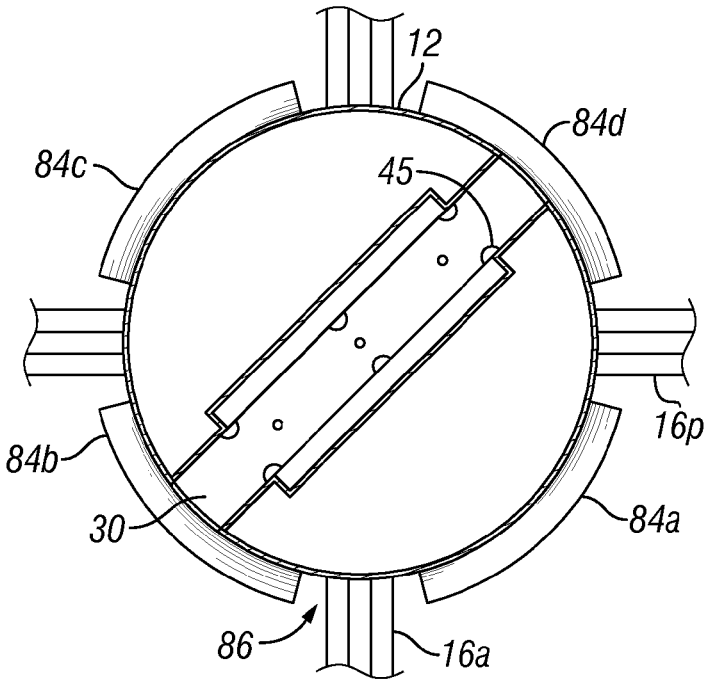

FIG. 9 depicts a horizontal cross section taken through the buoyant hull of the floatable offshore depot showing a straight tunnel formed completely there through.

In embodiments, the tunnel 30 can be a straight tunnel that passes completely through the buoyant hull 12 on a diameter.

The at least one of the fin-shaped appendage 84*a*-84*d* can be used for creating added mass and for reducing heave and otherwise steadying the floatable offshore depot 10. A plurality of fin-shaped appendages 84*a*-84*d* can be attached to a lower and outer portion of lower cylindrical side section of the buoyant hull 12.

In one or more embodiments as shown, the plurality of fin-shaped appendages 84*a*-84*d* can have at least four fin-shaped appendages separated from each other by gaps. A gap 86 is shown to accommodate one of the plurality of catenary mooring lines 16*a* on the exterior of buoyant hull 12 without contact with the plurality of fin-shaped appendages 84*a*-84*d*. The plurality of catenary mooring lines 16*a*-16*p* is also shown.

Figure 10:
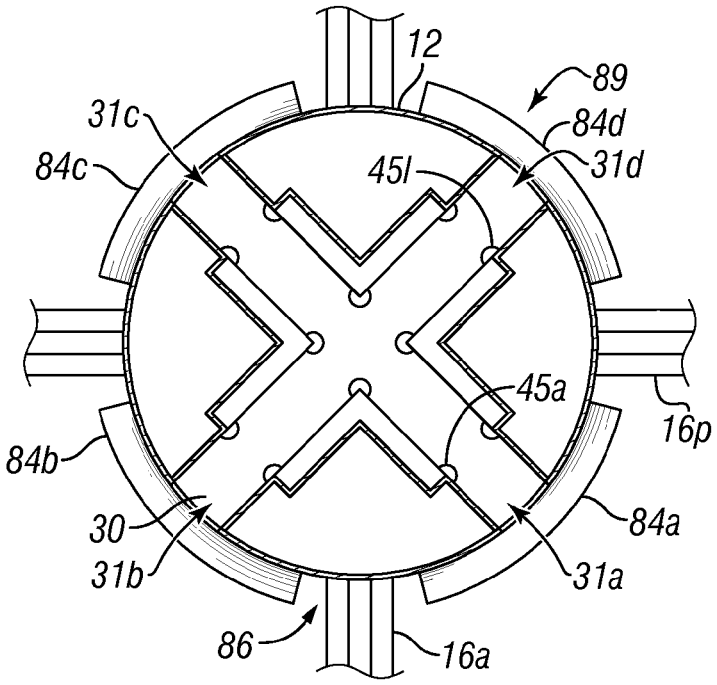
FIG. 10 depicts a horizontal cross section taken through the buoyant hull of the floatable offshore depot according to one or more embodiments.

FIG. 10 depicts a horizontal cross section taken through the buoyant hull 12 of the floatable offshore depot according to one or more embodiments.

In embodiments, the tunnel 30 can be a cruciform shaped tunnel, which can have entrances formed through the buoyant hull 12 at ninety degree intervals.

In this embodiment, the cruciform shape 89 creates a plurality of tunnel openings 31*a*-31*d* in the buoyant hull 12 of the floatable offshore depot.

The tunnel 30 provides four entrances disposed at ninety-degree intervals about buoyant hull 12. The floatable offshore depot can be ideally moored so that at least one of the plurality of tunnel openings 31*a*-31*d* can be leeward of prevailing winds, waves and currents.

Each of the plurality of tunnel opening 31*a*-31*d* can be formed in the buoyant hull to the exterior for the tunnel 30. Each of the tunnel openings of the plurality of tunnel openings 31*a*-31*d* can have at least one tunnel fender 45*a*-451.

The at least one fin-shaped appendage 84*a*-84*d* is depicted along with the plurality of catenary mooring lines 16*a*-16*p*. The gap 86 is shown to accommodate the one of the plurality of catenary mooring lines 16*a* on the exterior of the buoyant hull 12 without contact with the at least one fin-shaped appendages 84*a*-84*d*.

Figure 11:
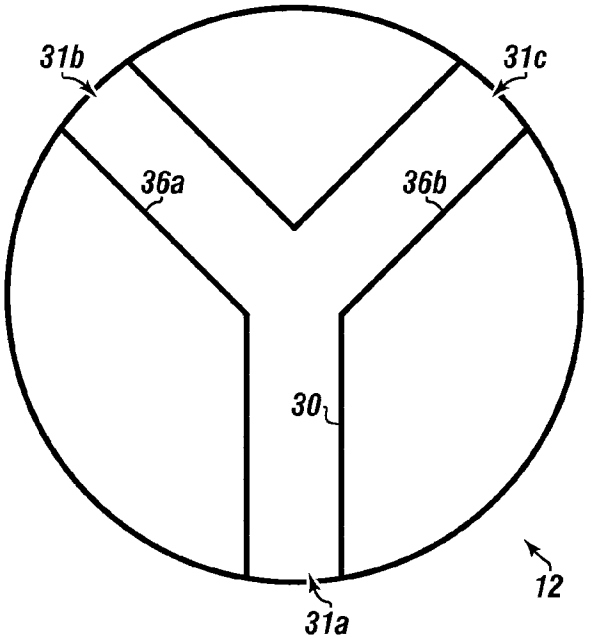
FIG. 11 depicts a top view of a Y-shaped tunnel in the buoyant hull of the floatable offshore depot.

FIG. 11 depicts a top view of a Y-shaped tunnel in the buoyant hull of the floatable offshore depot.

In embodiments, the tunnel 30 can be in a Y-shaped in the buoyant hull 12 with the tunnel opening 31*a*, in communication with a first branch 36*a* and a second branch 36*b* going to an additional tunnel opening 31*b* and 31*c* respectively.

In operation, the fast transport unit FTU or similar watercraft can arrive in the proximity of the moored and stable floatable offshore depot. The watercraft ideally can approach the entrance to the tunnel which can be the tunnel entrance most sheltered from the effects of wind, waves, and current. If not already in a flooded state, the tunnel can be flooded. The at least one closeable door can be opened, and the watercraft can then enter the tunnel under its own power. The at least one door fender and the at least one self-guiding stabbing dock shape of tunnel the tunnel can provide safe and reliable clearance guidance. More than one self-guiding stabbing dock shape can be used.

The at least one tunnel fender can eliminate or drastically reduce riding and bouncing of the watercraft against the internal dock side of the tunnel. After the watercraft clears the entrance, the at least one closeable door can be shut to reduce wave, wind and swell effects from the outer environmental conditions. The watercraft can then align over the boatlift assembly, optionally aided by the use of controlled and monitored underwater cameras and transporter systems. The watercraft can then be lifted by the boatlift assembly as desired. The reverse procedure can be used to launch the watercraft.

The floatable offshore depot can be designed and sized to meet the requirements of any particular application. The dimensions can be scaled using the well-known Froude scaling technique. The dimensions of the tunnel, which can be scaled as appropriate, are approximately 17 meters wide by 21 meters high. Such dimensions are appropriate for the tri-hull FTUs described above.

In embodiments of the method, the floatable offshore depot can have a floating transit depth and an operational depth, wherein the operational depth can be achieved using ballast pumps and filling ballast tanks in the buoyant hull with water after moving the structure at floating transit depth to an operational location.

In embodiments of the method, the floating transit depth can be from about 7 meters to about 15 meters, and the operational depth can be from about 45 meters to about 65 meters. The tunnel can be out of the water during transit.

In further embodiments of the method, a straight, a curved, or a tapering section in the buoyant hull forms the tunnel.

In embodiments of the method, the method provides a resort including gaming and/or entertainment on the floatable offshore depot.

In embodiments of the method, the method provides military staging site on the floatable offshore depot.

In embodiments of the method, the plates, the at least one closable door, and the buoyant hull can be made from steel.

In embodiments of the method, the floatable offshore depot can have the lower frustoconical side section extending downwardly from the upper cylindrical side section.

In embodiments of the method, the floatable offshore depot comprises a frustoconical side section between the transition section and the lower frustoconical side section.

In embodiments of the method, the method can use the floatable offshore depot to provide a sheltered area inside the buoyant hull using a tunnel for safe and easy launching/docking of watercraft and embarkation/debarkation of personnel using an internal dock side of tunnel and to provide a sheltered area inside the buoyant hull for transferring equipment between the watercraft and the floatable offshore depot using an internal dock side of tunnel.

The method can use the floatable offshore depot having a buoyant hull with a hull planform that is circular, oval, elliptical, or polygonal.

In embodiments of the method, the buoyant hull can have a matching keel and a main deck.

In embodiments of the method, between the buoyant hull and main deck can be at least two connected sections joined in series and symmetric about a vertical axis.

In embodiments of the method, the connected sections can extend downwardly from the main deck toward the matching keel, and can have at least two of: the upper cylindrical side section, the transition section, and the lower cylindrical section.

In further embodiments of the method, the buoyant hull can have a tunnel at an operational depth. The tunnel can have a tunnel opening in the buoyant hull opening to an exterior of the buoyant hull and dimensioned so as to receive a watercraft.

In embodiments of the method, the floatable offshore depot can have a lower frustoconical side section to extend downwardly from the upper cylindrical side section.

In embodiments of the method, the floatable offshore depot can have an upper conical section between the transition section and the lower frustoconical side section.

In embodiments of the method, the floatable offshore depot provides for selective isolation of said tunnel from said exterior; whereby said tunnel can be operable in either a wet condition or a dry condition while said floatable offshore depot floats in a body of water.

In embodiments of the method, the floatable offshore depot can be configured to keep the tunnel in either a wet condition or a dry condition while the floatable offshore depot floats in a body of water.

In embodiments of the method, the floatable offshore depot can have a second tunnel opening in the buoyant hull to an exterior of the buoyant hull for the tunnel.

In embodiments of the method, the floatable offshore depot can have the first and the second branches for the tunnel, wherein each branch can penetrate through the buoyant hull.

In embodiments of the method, the floatable offshore depot can have a cruciform shape for the tunnel creating a plurality of tunnel openings in the buoyant hull.

In embodiments of the method, the floatable offshore depot can have: the main deck configured to carry a superstructure thereon; and said superstructure can include at least one member selected from the group consisting of: the berthing facility, the accommodations, the at least one heliport, the at least one crane, the control tower, and the at least one aircraft hangar.

In embodiments of the method, the floatable offshore depot can have: optional baffles to reduce waves within the tunnel.

In embodiments of the method, the floatable offshore depot can have: the moon pool configured to engage the tunnel with the moon pool configured to open through the matching keel.

In embodiments of the method, the floatable offshore depot can have the at least one tunnel fenders disposed within the tunnel to reduce wave action and provide clearance guidance to the watercraft and outside the tunnel opening enabling self-guiding of the watercraft into the tunnel.

In embodiments of the method, the floatable offshore depot can have a self-guiding stabbing dock shape for the tunnel.

In embodiments of the method, the floatable offshore depot can have the gangway for traversing between the structure and an adjacent structure.

In embodiments of the method, the floatable offshore depot can have a buoyant hull with a low center of gravity providing an inherent stability to the structure.

In embodiments of the method, the floatable offshore depot can have at least one fin-shaped appendage attached to a lower portion and an outer portion of the exterior of the buoyant hull.

In embodiments of the method, the floatable offshore depot can have the lower tapering surface at an entrance of the tunnel, providing a "beach effect" that absorbs most of a surface wave's energy.

In embodiments of the method, the floatable offshore depot can have a tunnel floor with the floatable offshore depot adapted for draining the tunnel so as to create a dry dock environment within the buoyant hull.

In embodiments of the method, the floatable offshore depot a straight, a curved, or a tapering section in the buoyant hull forming the tunnel.

In embodiments of the method, the floatable offshore depot can have the plurality of thrusters and the plurality of catenary mooring lines to either dynamic moor the floatable offshore depot to the seabed or to provide dynamic positioning while in communication with a global positioning system.

In embodiments of the method, the floatable offshore depot can be configured to float on a body of water as well as to ballast down and sit on a seabed. In essence this particular floatable offshore depot can be adapted to both float at two different levels as well as sit on a seabed for differing operational and transiting uses.

While these embodiments have been described with emphasis on the embodiments, it should be understood that within the scope of the appended claims, the embodiments might be practiced other than as specifically described herein.

What is claimed is:

1. A method using a floatable offshore depot, the method comprising:

a. providing a sheltered area inside a buoyant hull configured as a tunnel for safe and easy launching or docking of a watercraft and embarkation or debarkation of personnel using an internal dock side of the tunnel; and b. providing the sheltered area inside the buoyant hull configured as the tunnel for transferring equipment between the watercraft and the floatable offshore depot using the internal dock side of the tunnel; and wherein the floatable offshore depot comprises:

(i) the buoyant hull with a hull planform that is circular, oval, elliptical, or polygonal;

(ii) a matching keel and a main deck, wherein the main deck and the matching keel are configured for offshore stability; and (iii) at least two connected sections engaging between the matching keel and the main deck, the at least two connected sections joined in series and symmetric about a vertical axis with the at least two connected sections extending downwardly from the main deck toward the matching keel, the at least two connected sections comprising at least two of:

1. an upper cylindrical side section;

2. a transition section; and 3. a lower cylindrical section; and wherein the tunnel of the buoyant hull formed within the buoyant hull for receiving the watercraft when the buoyant hull is at an operational depth, the tunnel comprising: a tunnel opening in the buoyant hull opening to an exterior of the buoyant hull and dimensioned so as to receive the watercraft, and further wherein the floatable offshore depot is configured to be floatable to transition from the floating operational depth or a floating transit depth to resting on a seabed.

2. The method of claim 1, wherein the floatable offshore depot comprises a lower frustoconical side section to extend downwardly from the upper cylindrical side section.

3. The method of claim 1, wherein the floatable offshore depot comprises an upper conical between the transition section and the lower frustoconical side section.

4. The method of claim 1, wherein the floatable offshore depot provides for selective isolation of the tunnel from the exterior of the buoyant hull, wherein the tunnel is operable in either a wet condition or a dry condition while the floatable offshore depot floats or rests on the seabed.

5. The method of claim 1, wherein the floatable offshore depot comprises an additional tunnel opening in the buoyant hull to the exterior of the buoyant hull.

6. The method of claim 1, wherein the floatable offshore depot comprises at least one branch for the tunnel, wherein each branch has an additional tunnel opening.

7. The method of claim 1, wherein the floatable offshore depot comprises a cruciform shape for the tunnel creating a plurality of tunnel openings in the buoyant hull.

8. The method of claim 1, wherein the floatable offshore depot comprises the main deck configured to carry a superstructure, wherein the superstructure includes at least one member selected from the group consisting of: a berthing facility, accommodations, a take-off and landing surface, a crane, a control tower, and an aircraft hangar.

9. The method of claim 1, wherein the floatable offshore depot comprises a plurality of baffles to reduce waves within the tunnel.

10. The method of claim 1, wherein the floatable offshore depot comprises a moon pool configured to fluidly engage the tunnel and to open through the matching keel.

11. The method of claim 1, wherein the floatable offshore depot comprises a plurality of fenders, wherein the plurality of fenders are at least one door fender and at least one tunnel fender positioned at a location within the tunnel to reduce wave action and provide clearance guidance to the watercraft and outside the tunnel opening enabling self-guiding of the watercraft into the tunnel.

12. The method of claim 1, wherein the floatable offshore depot comprises a self-guiding stabbing dock shape for the tunnel.

13. The method of claim 1, wherein the floatable offshore depot comprises a gangway for traversing between the floatable offshore depot and an adjacent structure.

14. The method of claim 1, wherein the floatable offshore depot comprises the buoyant hull with a low center of gravity providing an inherent stability to the floatable offshore depot.

15. The method of claim 1, wherein the floatable offshore depot comprises at least one fin-shaped appendage attached to a lower and outer portion of the exterior of the buoyant hull.

16. The method of claim 1, wherein the floatable offshore depot comprises a lower tapering surface at an entrance of the tunnel, providing a "beach effect" that absorbs surface wave energy.

17. The method of claim 1, wherein the floatable offshore depot comprises a tunnel floor enabling creation of a dry dock environment within the buoyant hull when the tunnel is drained of water.

18. The method of claim 1, wherein the floatable offshore depot comprises at least one of: a straight, a curved, or a tapering section in the buoyant hull forming at least one of: a first tunnel side and a second tunnel side.

19. The method of claim 1, wherein the floatable offshore depot comprises a plurality of thrusters and a plurality of catenary mooring lines to either dynamic moor the floatable offshore depot to the seabed or dynamically position the floatable offshore depot while in communication with a dynamic positioning system.

20. The method of claim 1, wherein the floatable offshore depot comprises a plurality of take-off and landing surfaces, wherein each of the take-off and landing surfaces configured to enable a plurality of take-off and landing aircraft to take-off and land simultaneously from one of the plurality of take-off and landing surfaces.

* * * * *